United States Patent [19]

Rapp

[11] 4,364,108

[45] Dec. 14, 1982

[54] LUMINAIRE COVER LOCKING APPARATUS

[75] Inventor: William J. Rapp, Hayward, Calif.

[73] Assignee: Gardco Manufacturing, Inc., San Leandro, Calif.

[21] Appl. No.: 224,096

[22] Filed: Jan. 12, 1981

[51] Int. Cl.[3] ..... F21V 17/00; F21V 29/00

[52] U.S. Cl. ..... 362/374; 362/310; 362/311; 362/375; 362/376

[58] Field of Search ..... 362/374, 375, 376, 310, 362/311, 368

[56] References Cited

U.S. PATENT DOCUMENTS

| | | | |
|---|---|---|---|
| 1,357,539 | 11/1920 | Bissell | 362/376 |
| 3,461,283 | 8/1969 | Hahn | 362/368 |
| 4,001,778 | 1/1977 | Ross | 362/376 |
| 4,141,061 | 2/1979 | Ford et al. | 362/368 |
| 4,155,111 | 5/1979 | Kelly et al. | 362/374 |
| 4,323,954 | 4/1982 | Florence et al. | 362/375 |

*Primary Examiner*—Irwin Gluck
*Attorney, Agent, or Firm*—Robert W. Dilts

[57] ABSTRACT

A luminaire includes a light source mounted within a housing having an opening through which light from the source is distributed. The opening also provides access to the interior of the housing for maintenance of the light source and is closed by a cover which is at least partially translucent and which is hinged to the housing at one end and provided with a pair of spring loaded pins projecting from the sides thereof at the other end to hold the cover in closed position or to be retracted by means of clips to open the cover. The protection of the light source afforded by the housing is improved by an elongated rigid member adapted to extend between the clips of the pins to prevent the pins from being retracted. The clips include coaxial channels and the rigid member includes a reduced portion at one end and a retractable finger at the other end, both of which are dimensioned to be received in such channels.

4 Claims, 6 Drawing Figures

LUMINAIRE COVER LOCKING APPARATUS

DESCRIPTION

1. Technical Field

The present invention relates generally to luminaire hardware, and more particularly, to a luminaire cover locking apparatus for securing a luminaire cover to a luminaire housing and for hindering the theft or vandalization of the luminaire light source.

2. Background Art

A typical luminaire includes a generally hollow housing which is mounted to a ceiling or a free standing support structure. The housing contains a light source, which may be a high intensity arc lamp together with associated electrical circuit elements, such as a ballast, and a reflector for directing light energy through an opening in the housing in a selected pattern. The luminaire further includes a luminaire cover hinged to the housing and having a frame portion and a translucent portion carried by the frame portion dimensioned to be received within the opening. The frame portion carries spring biased pins for holding the cover within the housing opening. A clip is connected to each pin for manually retracting each pin into the frame, whereby the spring is compressed, during opening and closing of the cover.

Thus, the cover may be supported on the housing in a hinged position to allow access to the inside of the luminaire housing for maintenance including the removal and replacement of the high intensity arc lamp. The hinge means is generally disposed along an inside portion of the cover and is inaccessible after the cover has been closed. The closing of the cover is completed by rotating the cover on the hinge means into the opening and manually positioning the pair of pins inwardly by means of the clips associated with the pins. When the cover is in place within the opening the clips are released and spring force will push the pair of pins outward into apertures within the housing for receiving the pins to hold the cover in closed position. The clips associated with the pair of pins are disposed along an outside portion of the luminaire cover to be accessible for the subsequent removal of the cover.

The luminaire may typically be used in low security areas such as along streets, in parking lots or in building structures such as an underground parking garage or the like. It is desirable to protect the luminaire and more particularly, the light source from theft or vandalism within the low security area. The light source is usually a relatively expensive item, being commonly a high intensity arc lamp of sodium or mercury vapor type. The clips associated with the pair of pins are easily accessible to those persons who may wish to the cover and remove the high intensity arc lamp for its own value or to aid in the perpetration of a violent crime in the low security area. Generally, it is desirable for only authorized persons to be able to open the luminaire cover.

It is therefore an object of the present invention to provide a luminaire cover locking apparatus to allow the nondestructive removal of the luminaire cover only by authorized persons.

It is still a further object of the present invention to provide a luminaire cover locking apparatus which is simple in construction while providing a reasonable deterent to vandalism.

SUMMARY OF THE INVENTION

According to the invention, an improvement is provided in a luminaire including a housing having an opening, and a cover for the opening. The cover has a frame hinged to the housing at one end of the opening, a translucent panel carried by the frame, and a pair of pins each spring biased to extend longitudinally outward from a different one of a pair of side members of the frame. Each of the pair of pins carries a clip extending outwardly from a face of the frame for manual engagement to retract the pins into the frame against the spring bias. The improvement comprises a coaxial channel in the clips and an elongated rigid member dimensioned to extend between the clips. The elongated member has a reduced portion at one end dimensioned to be received in one of the channels, and retractable means disposed in a bore at the other end to be received in the other one of the channels.

DETAILED DESCRIPTION OF THE DRAWING

Figure 1:
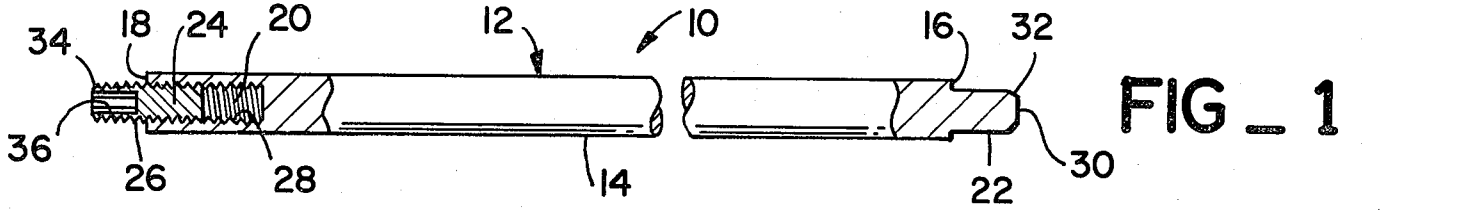
FIG. 1 is a fragmentary view, partially in cross-section, illustrating a luminaire cover locking device according to the principles of the present invention.

Referring now to FIG. 1, there is shown an embodiment of the luminaire cover locking apparatus 10 according to this invention comprising an elongated member 12 including a rigid body portion 14 with a reduced portion 22 at one end 16 thereof. The other end 18, of the member 12 has an axial bore 20 therein. A generally cylindrical retractable finger means 24 is disposed in the bore 20. According to this embodiment, the finger means 24 has a threaded portion 26 and the bore 20 has a threaded inner surface 28 commensurate with threaded portion 26. The reduced portion at the end 16 of the member 21 and the finger means 24 preferably are of equal diameter less than the diameter of rigid body portion 14. The free end 30 of the reduced portion 22 has a chamfered edge 32. The free end 34 of the finger means 24 has a hexagonal opening 36 disposed therein. The depth of bore 20 in the end portion 18 of the member 12 is at least as large as the axial length of the finger means 24.

Figure 2B:
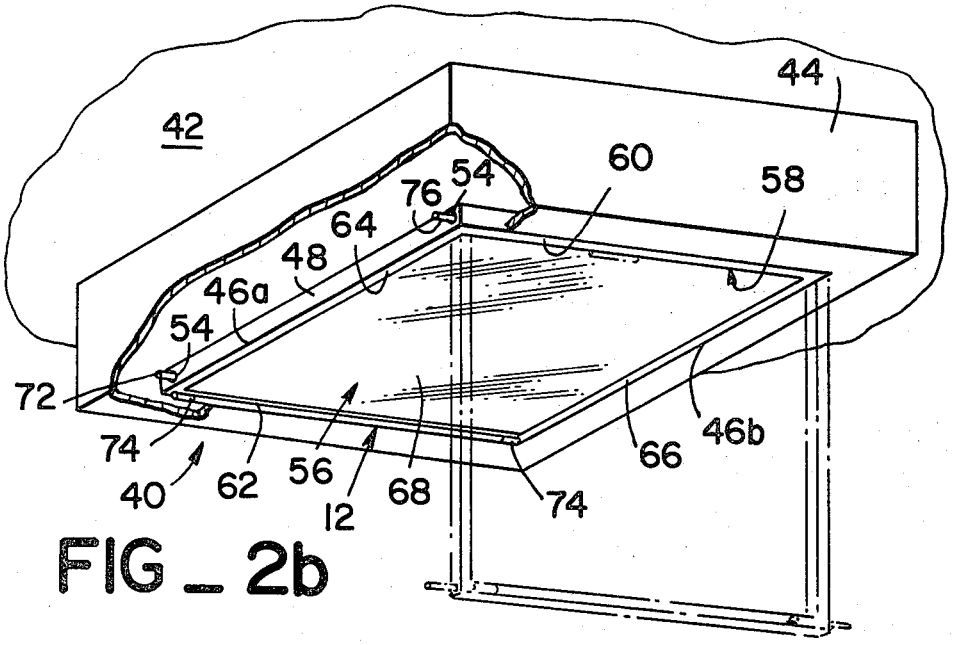
FIGS. 2*a* and 2*b* are perspective views, partially broken away, illustrating the relative placement of the locking device of FIG. 1 with respect to a luminaire.
Figure 2A:
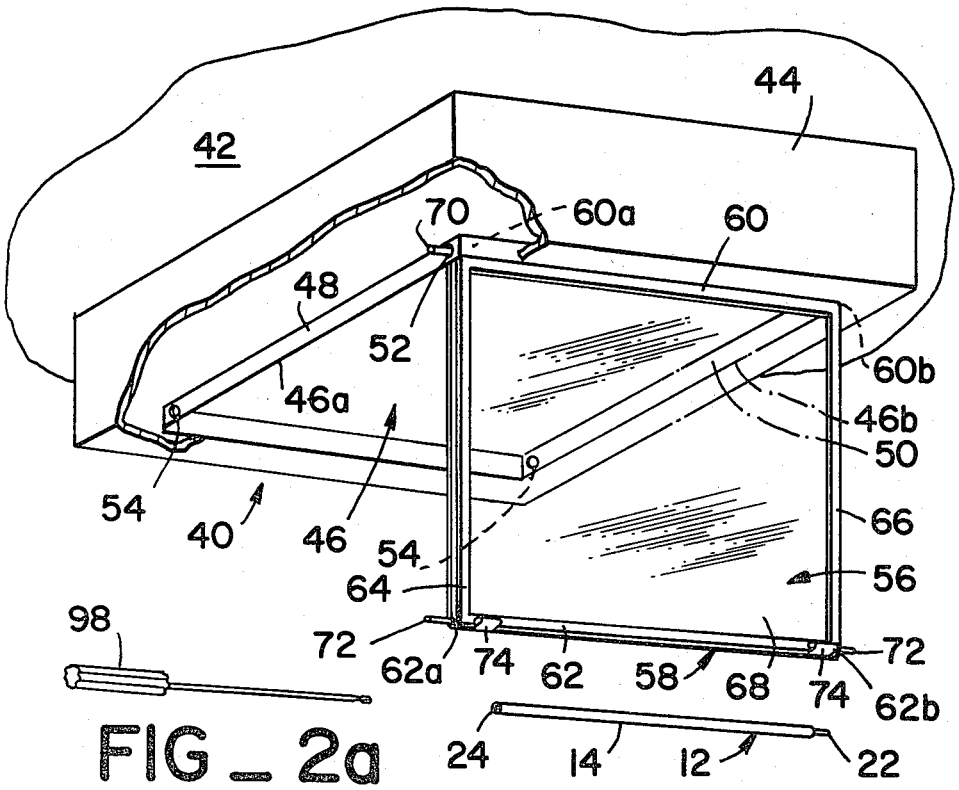

Referring now to FIGS. 2*a* and 2*b*, there is shown a typical luminaire 40 mounted in the usual manner to a ceiling 42. A luminaire housing 44 includes a generally rectangular opening 46, having opposite edges 46*a* and 46*b*, a first flange 48 and a second flange 50. Each flange 48 and 50 extends inwardly from edges 46*a* and 46*b*, respectively, and has a first aperture 52 and a second aperture 54.

A luminaire cover 56 includes a frame 58 having a first member 60, a second member 62 parallel to first member 60, a pair of parallel cross-members 64 and 66 extending between members 60 and 62, a translucent portion 68 carried by frame 58. One end of the frame is hinged to the housing as, for example, by a pair of first pins 70, each first pin 70 extending longitudinally outwardly from a different one of opposite end portions 60*a* and 60*b* of first member 60 and received within the first aperture 52 in the flanges 48 and 50. The cover 56 is locked in position closing the opening 46 by means of a pair of second pins 72, each second pin 72 extending longitudinally outwardly from a different one of opposite end portions 62*a* and 62*b* of second member 62 and received within the second apertures 54 in the flanges 48 and 50. A pair of clips 74 are associated with second pins 72 for manually retracting them during the opening and closing of the cover 56.

Figure 3:
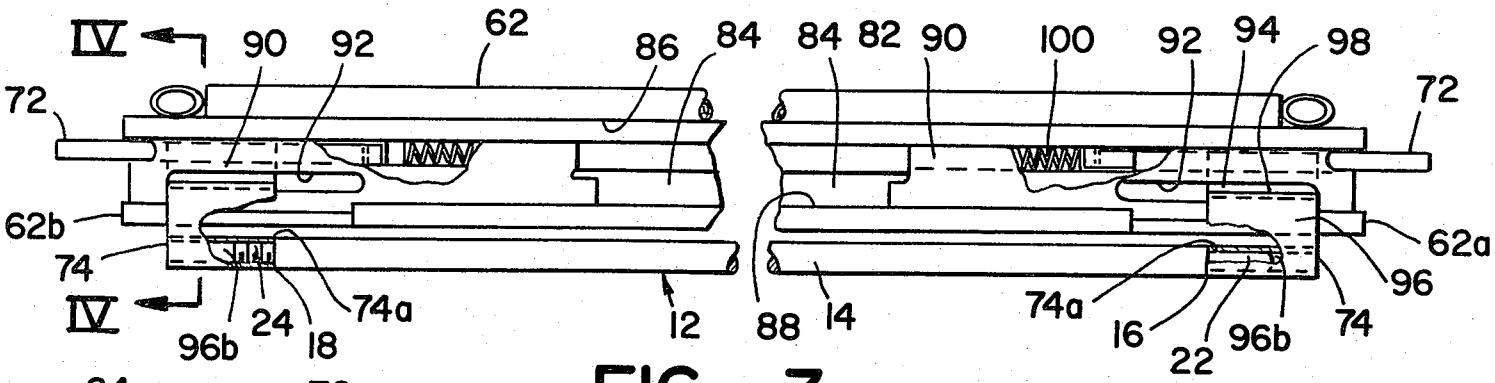
FIG. 3 is an enlarged end view in elevation of the luminaire cover of FIG. 2*b*, partially broken away, to illustrate details of an embodiment of this invention.
Figure 5:
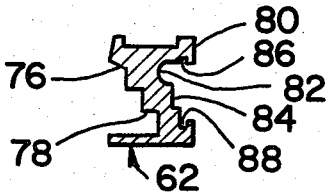
FIG. 5 is a cross-sectional view illustrating a detail of FIG. 4.
Figure 4:
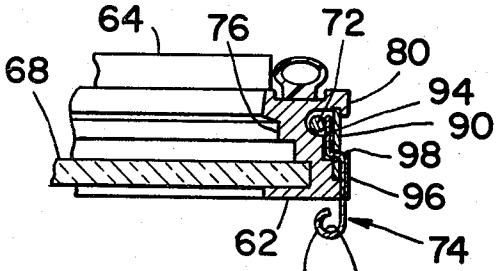
FIG. 4 is a fragmentary, cross-sectional view taken along line IV—IV of FIG. 3.

A more detailed understanding of luminaire cover 56 according to this embodiment of the invention may be obtained by referring now to FIGS. 3, 4 and 5. As best shown in FIG. 5, second member 62 (and each of the other members 60, 64 and 66) includes an inner face 76 having a first rectangular groove 78 longitudinally disposed along inner face 76 for receiving translucent portion 68, and an outer face 80 having an arcuate groove 82 longitudinally disposed along member 62, a second rectangular groove 84 communicating with the lower side portion of groove 82 and being longitudinally disposed in member 62, and a pair of longitudinally disposed slits 86 and 88 communicating with the upper side portion of groove 82 and the lower side portion of groove 84, respectively.

Disposed at a different one of opposite edge portions 62*a* and 62*b* of second member 62 are a pair of generally rectangular retaining plates 90 carried by slits 86 and 88. Each retaining plate 90 includes an elongated slotted opening 92. Each clip 74 includes a first body portion 92 coupled to a different one of each of second pins 72 and a second body portion 96 extending downwardly from outer face 80, and a rib portion 98 connecting first and second body portions 94 and 96 and being carried by slotted opening 92 in linear slidable engagement. Slotted opening 92 communicates with second rectangular groove 84. Slotted opening 92 allows clip 74 to be carried on outer face 80 in linear slidable engagement between an inner or removal position and an outer or mounting position, the mounting position being shown in FIG. 3. The mounting spring 100, carried in arcuate groove 82 normally biases each pin 72 and clip 74 in the mounting position. Second body portion 96 has an upwardly extending arcuate lip 96*a* defining a channel 96*b*. The diameter of rigid body portion 14 is commensurate with the outer diameter of arcuate lip 96*a* so that first and second end portions 16 and 18 abut against inner edges 74*a* of each clip 74. Rigid body portion 14 is longitudinally dimensioned commensurate with the distance between each inner edge 74*a* when each clip is in the mounting position.

The construction and design of a luminaire to which the improvement of the present invention is applicable having been hereinabove described, the mode of operation of this invention is hereinafter described in detail.

After luminaire cover 56 has been received into rectangular opening 46, each clip 74 is disposed in the hereinabove described mounting position, whereby each of second pins 72 is received into a different one of second apertures 54 securing luminaire cover 56 to luminaire housing 44. The reduced portion 22 at the end 16 of locking apparatus 10 is received into channel 96*b* of one of clips 74. The finger means 24 is disposed entirely within bore 20 to allow rigid body portion 14 to be positioned between the clips 74. A tool 98 (FIG. 2*a*) commensurate with hexagonal opening 36, such as an allen wrench, is received into the channel 96*b* of the other clip 74 and engaged within hexagonal opening 36. The finger means 24 is screwed outwardly from bore 20 utilizing tool 98 until end portion 34 of finger means 24 is disposed within channel 96*b*. The tool is removed and locking of clips 74 in the mounting position is accomplished. Only those persons having tool 98 and knowing the position of finger means 24 can non-destructively remove locking apparatus 10. Preferably, second body portion 96 of each clip 74 is dimensioned so that locking apparatus 10 is spaced about 3/32" from second member 62. It is contemplated that this spacing as well as the relative closeness of luminaire 40 to ceiling 42 would inhibit attempts by a person to look through channel 96 to ascertain the means for securing locking apparatus 10 therein.

Other aspects, objects and advantages of this invention can be obtained from a study of the drawings, the disclosure and the appended claims.

What is claimed is:

1. In a luminaire including a housing having an opening and a cover for said opening, said cover including a frame having a pair of end members, a pair of side members extending between said pair of end members, a translucent panel carried by said frame, one end of said frame being hinged to said housing at one end of said opening, and a pair of pins each spring biased to extend longitudinally outward from a different one of said pair of side members at the other end of said frame, said housing having means for receiving said pins at said opening, each of said pair of pins carrying a clip extending outwardly of the face of said frame for manual engagement to move said clips toward each other and retract said pins into said frame against said spring bias, the improvement comprising coaxial channel means in said clips, an elongated rigid member, said elongated rigid member having a reduced portion at one end thereof dimensioned to be received in said channel means in said clips, said elongated rigid member being dimensioned to extend between said clips when said pins project outwardly from said side members and said reduced portion at one end thereof is received in said channel means in one of said clips, said elongated rigid member having a bore at the other end thereof, and rigid finger means retractably received in said bore of said elongated rigid member, said finger means being dimensioned to be received in said channel means of said clips.

2. In a luminaire including a luminaire housing having a generally rectangular opening, a first flange and a second flange, each flange extending inwardly from opposite edges of the opening and having a first and a second aperture, and a luminaire cover having a frame dimensioned to be received in the opening and having a first member, a second member parallel to the first member and a pair of parallel cross members extending between the first and second members, a translucent portion carried by an inner face of each of the members, a pair of first pins, each first pin extending longitudinally outward from a different one of opposite edge portions of the first member in linear slidable engagement and being received in a different one of each of the first apertures in rotational slidable engagement, a pair of second pins, each second pin extending longitudinally outward from a different one of opposite edge portions of the second member in linear slidable engagement and being dimensioned to be received in each of the second apertures, each second pin securing the luminaire cover to the luminaire housing when received into each of the second apertures, a pair of clips carried by an outer face of the second member in linear slidable engagement, each of the clips having a first body portion coupled to a different one of each of the second pins and a second body portion extending downwardly from the outer face of the second member for axially translating the pin longitudinally along the respective edge portion between a removal position and a mounting position, each second pin being received into a different one of the second apertures when the clips are in the mounting position, the second body portion having an arcuate lip extending upwardly from a lower edge of the second body portion defining an arcuate channel, the improvement in the luminaire cover comprising:

a generally elongated member for locking the clips in the mounting position including a generally rigid body portion being dimensioned commensurate with the distance between facing inner edges of the clips when in the mounting position and having a first end portion, a second end portion and a bore disposed in said second end portion, a first finger extending outwardly from said first end portion and being dimensioned to be received within the channel of one of the clips, and a second finger being dimensioned to be received within the channel of a different one of the clips and having means for mounting said second finger into said bore when each of said fingers are received into the respective one of the channels.

3. The improvement as in claim 2 in which said rigid body portion is generally cylindrical having a first diameter, said first finger being generally cylindrical and axially aligned with said rigid body portion and having a second diameter less than said first diameter.

4. The improvement as in claim 3 in which said second finger is generally cylindrical, said mounting means being a threaded portion on the arcuate surface of said second finger, said bore being an axial bore and having a threaded surface commensurate with said threaded portion.

* * * * *